US006039606A

United States Patent [19]

Chiou

[11] Patent Number: 6,039,606

[45] Date of Patent: Mar. 21, 2000

[54] CABLE CONNECTOR

[75] Inventor: Song-Rong Chiou, Lin-Kou, Taiwan

[73] Assignee: Hon Hai Precision Ind. Co., Ltd., Taipei Hsian, Taiwan

[21] Appl. No.: 09/342,659

[22] Filed: Jun. 28, 1999

[30] Foreign Application Priority Data

Sep. 25, 1998 [TW] Taiwan ..... 87215984

[51] Int. Cl.[7] ..... H01R 13/648

[52] U.S. Cl. ..... 439/610; 439/607

[58] Field of Search ..... 439/607–610

[56] References Cited

U.S. PATENT DOCUMENTS 5,683,269 11/1997 Davis et al. ..... 439/607

5,944,559 8/1999 Wu ..... 439/607

*Primary Examiner*—Hien Vu

*Attorney, Agent, or Firm*—Wei Te Chung

[57] ABSTRACT

A cable connector comprises a first shield having a base and a first shell extending from the base, a dielectric housing substantially received in the base, and a second shield having a second shell engaged with the first shell. The top surface of the base connected with the first shell defines two openings at both opposite sides thereof proximate the first shell. Side walls of the base each form a tongue proximate the first shell. A pair of posts project from a top surface of the housing corresponding to the openings of the base and a board projects from a bottom surface of the housing opposite the posts. Side walls of the dielectric housing each define a notch corresponding to the tongue of the base. A cover extends from the second shell for enclosing a cable.

7 Claims, 5 Drawing Sheets

CABLE CONNECTOR

BACKGROUND OF THE INVENTION

1. Field of the Invention

The present invention relates to a cable connector, and particularly to a shielded cable connector.

2. Description of Prior Art

As the development of communication technology progresses, the transmission speed of signals increases and higher quality of signal transmission is desired. A junction of the transmission path between a connector and a complementary connector can adversely affect the quality of signal transmission due to inadequate shielding of the connectors or improper connection between the connector and a cable. Thus, designing the cable connector to efficiently improve the quality of signal transmission is an important issue. Conventional cable connectors, such as those disclosed in U.S. Des. Pat. No. 378,209 and Taiwan Patent Application No. 85307118, have means to secure the cable, but the cable may easily rupture after repeated uses.

SUMMARY OF THE INVENTION

Accordingly, an object of the present invention is to provide a cable connector having top and bottom shields which are securely assembled thereto for preventing disconnection from an associated cable and for reliably eliminating electromagnetic disturbance.

In the preferred embodiment of the present invention, the cable connector comprises a first shield having a base and a first shell extending from the base, a dielectric housing substantially received in the base, and a second shield having a second shell engaged with the first shell. The top surface of the base connected with the first shell defines two openings in opposite sides thereof proximate the first shell. Side walls of the base each form a tongue proximate the first shell. The dielectric housing has a pair of posts projecting from a top surface thereof corresponding to the openings of the base and a board projecting from a bottom surface thereof opposite the posts. Side walls of the dielectric housing each define a notch corresponding to the tongue of the base. A cover extends from the second shell for enclosing a cable.

BRIEF DESCRIPTION OF THE DRAWINGS

Other objects and advantages of the present invention will be understood from the following description of a cable connector according to a preferred embodiment of the present invention shown in the accompanying drawings, in which.

DETAILED DESCRIPTION OF THE PREFERRED EMBODIMENT

Figure 1:
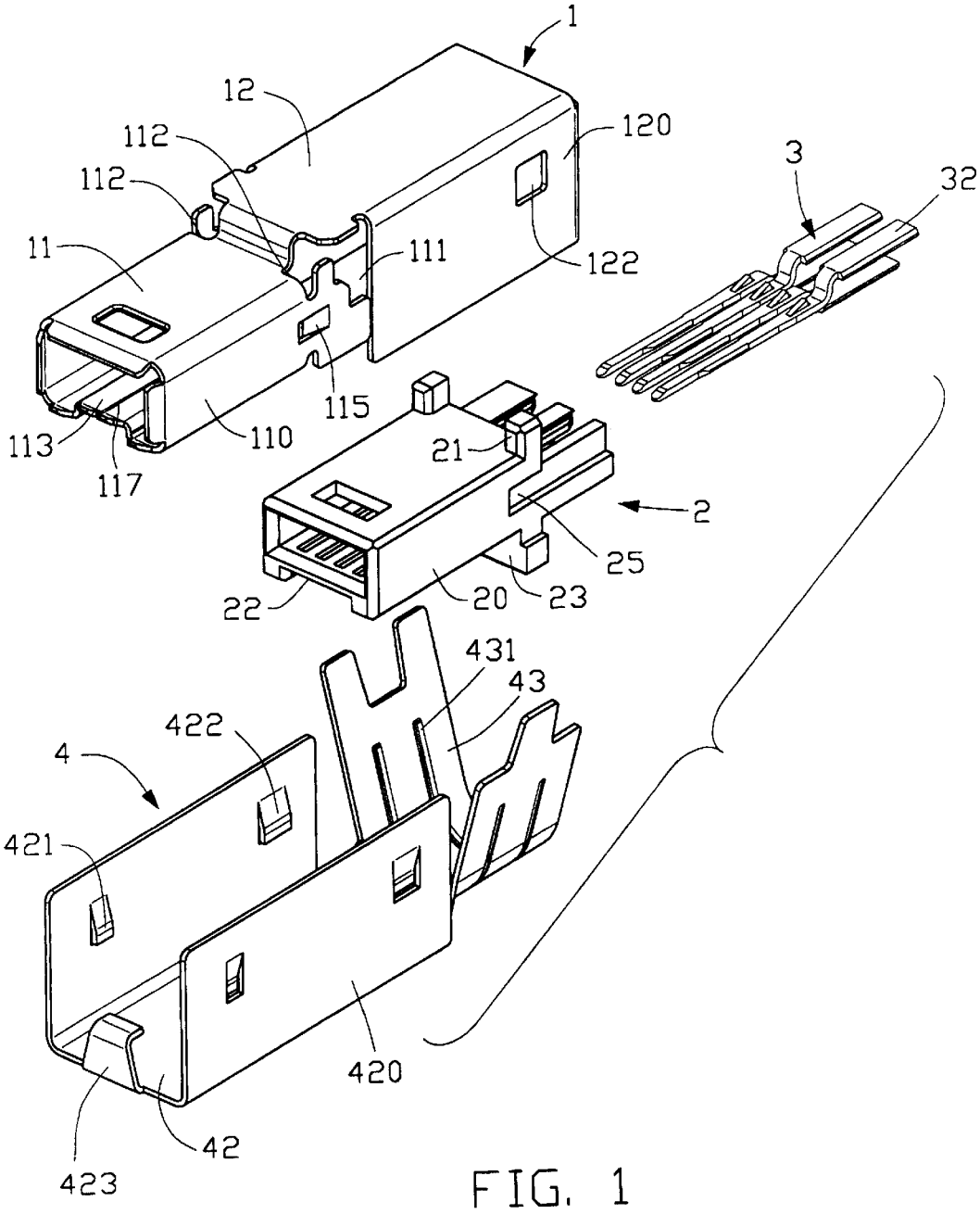
FIG. 1 is an exploded view of a cable connector embodying the concepts of the present invention.
Figure 2:
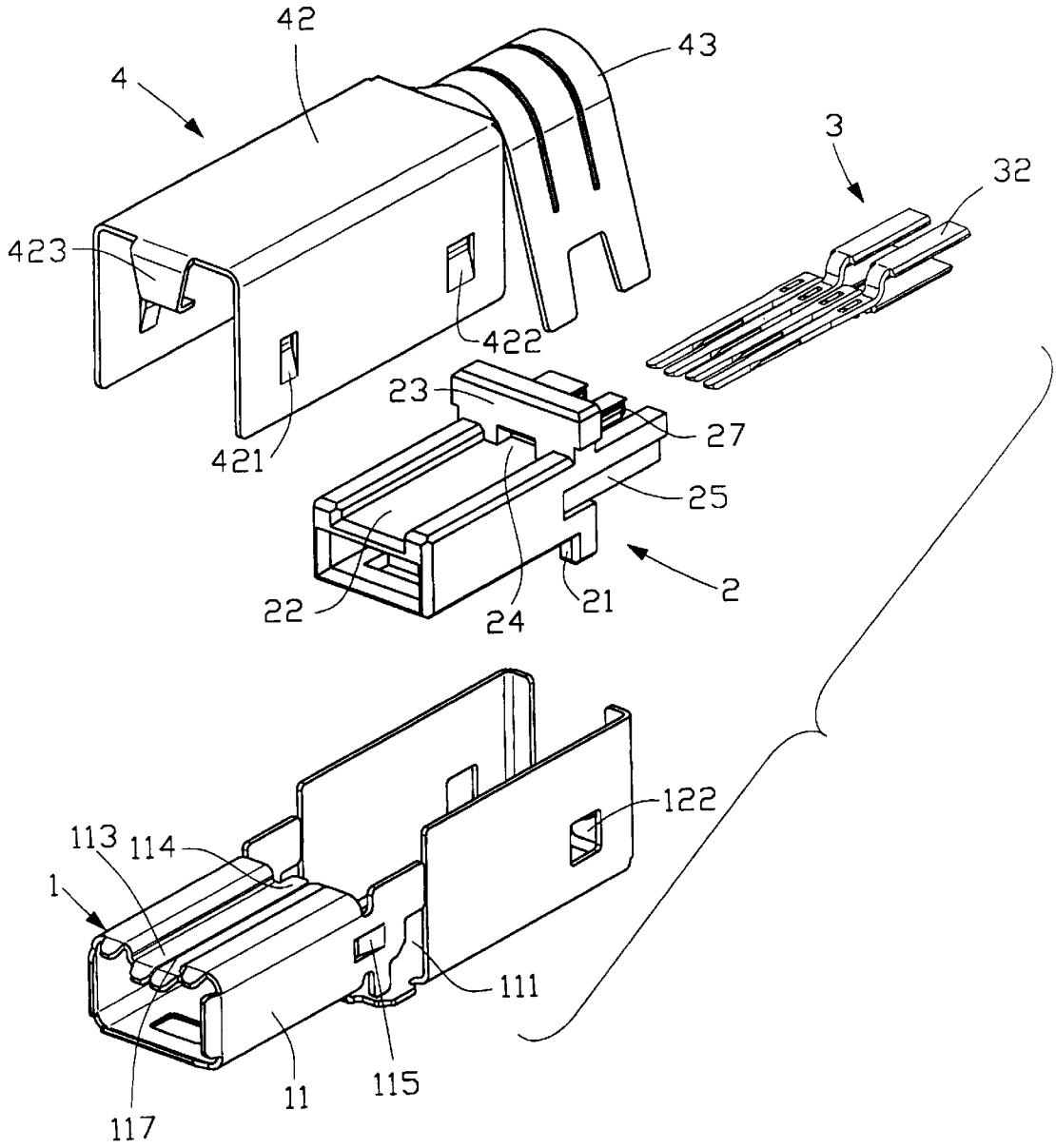
FIG. 2 is an exploded view similar to FIG. 1 taken from a different perspective.
Figure 3:
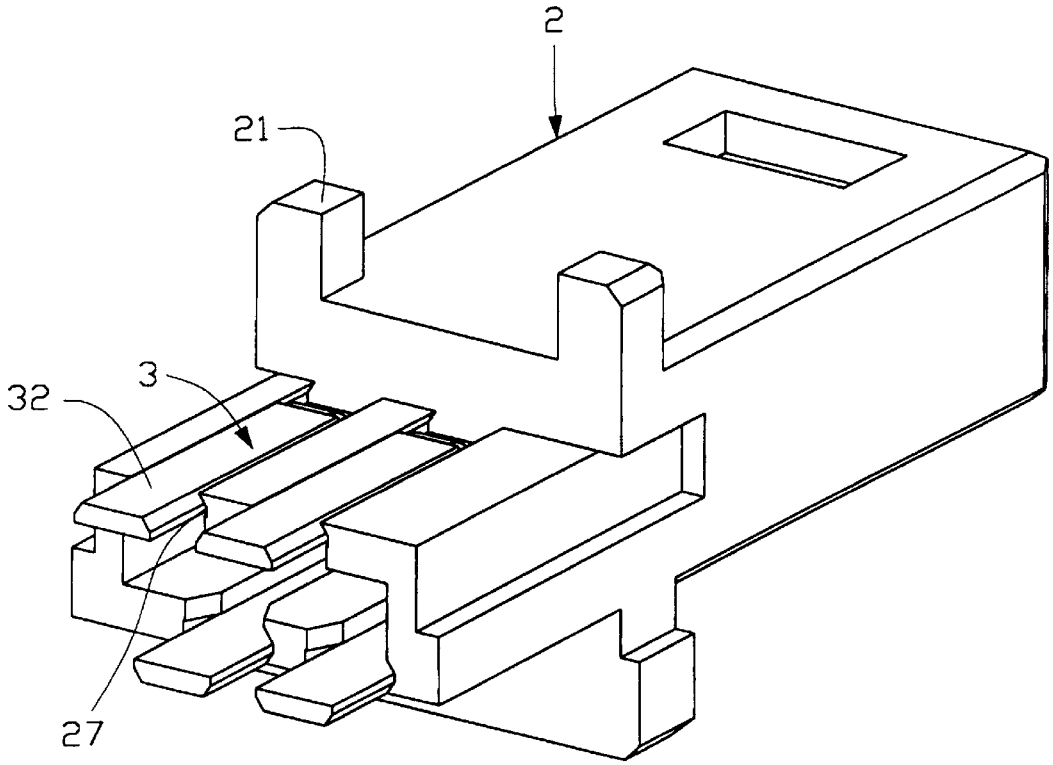
FIG. 3 is an assembled view of a dielectric housing and terminals of the present invention.
Figure 4:
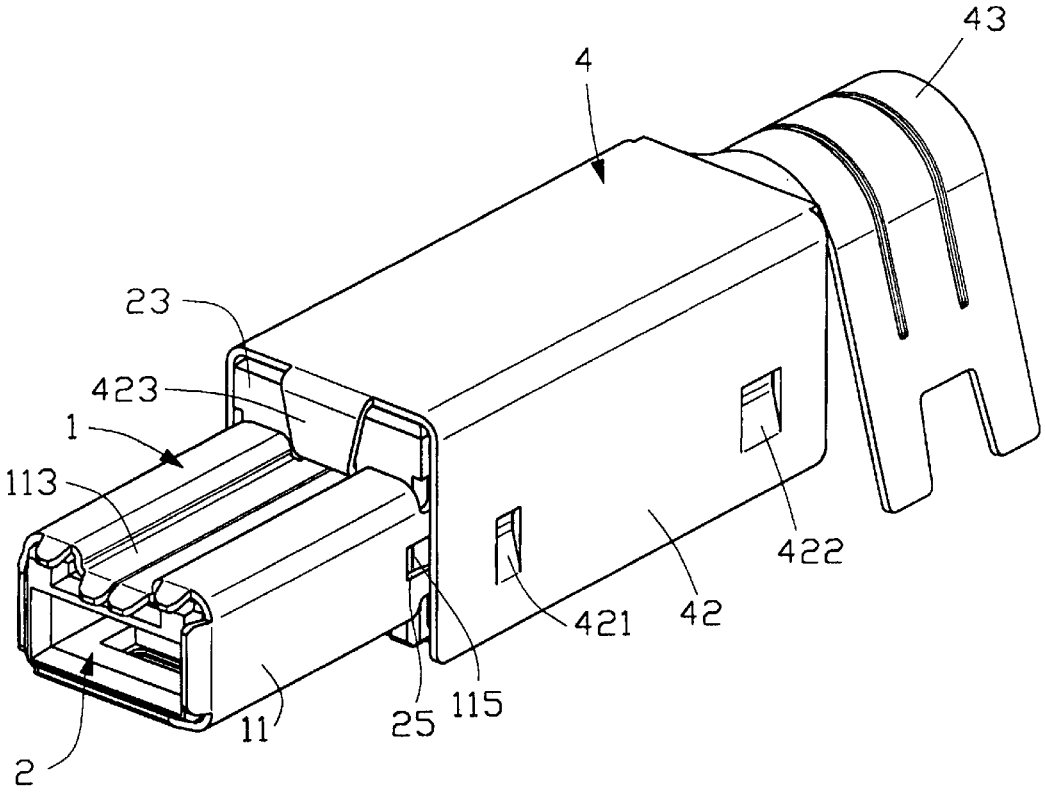
FIG. 4 is an assembled view of FIG. 2.
Figure 5:
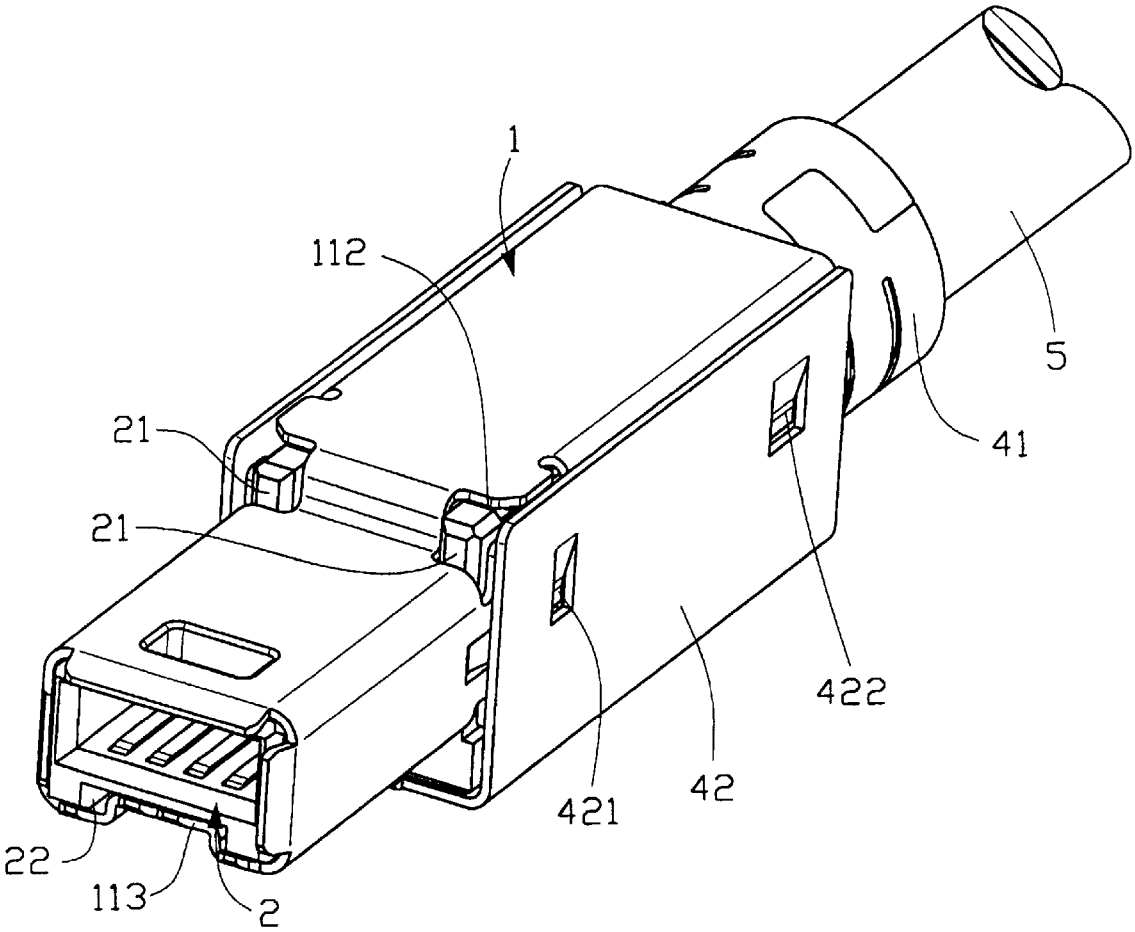
FIG. 5 is an assembled view of FIG. 1 with a cable assembled thereto.

Referring to FIGS. 1–5, a cable connector comprises a first shield 1, a dielectric housing 2, a plurality of terminals 3, and a second shield 4. The first shield 1 includes a base

11 and a first U-shaped shell 12 extending from the base 11. The second shield 4 includes a second U-shaped shell 42 engagable with the first U-shaped shell 12, and a V-shaped cover 43 extending from the second U-shaped shell 42 for covering a cable 5. Side walls 420 of the second U-shaped shell 42 are each inwardly stamped to form a narrow finger 421 and a wide finger 422 proximate opposite ends thereof and generally at the same height. The first shield 1 defines a hole 122 in opposite side walls 120 of the first U-shaped shell 12 corresponding to the wide fingers 422 of the second U-shaped shell 42, and a cutout 111 in opposite side walls 110 of the base 11 corresponding to the narrow fingers 421 of the second U-shaped shell 42. Thus, the first and second shields 1, 4 can be securely attached together by the narrow and wide fingers 421, 422 of the second shield 4 respectively engaging with the cutout 111 and the hole 122 of the first shield 1.

The top surface of the base 11 defines two openings 112 in opposite sides thereof proximate the first U-shaped shell 12. The bottom surface of the base 11 having two end edges 117 coupled together is inwardly stamped to form a longitudinal protrusion 113 along a central portion thereof. An insertion piece 114 extends from a distal end of the protrusion 113 proximate the first U-shaped shell 12. A tongue 115 is stampingly formed on each side wall 110 of the base 11 proximate the corresponding cutout 111. The dielectric housing 2 forms a pair of posts 21 projecting from a top surface thereof corresponding to the openings 112 of the base 11. A longitudinal recess 22 is defined in a bottom surface of the dielectric housing 2 corresponding to the longitudinal protrusion 113 of the base 11. A board 23 projects from the bottom surface of the housing 2 opposite the posts 21. The board 23 forms a slot 24 therein in communication with the longitudinal recess 22 and corresponding to the insertion piece 114 of the base 11. A notch 25 is formed in each of the two side walls 20 of the dielectric housing 2 corresponding to the tongue 115 of the base 11.

In assembly, the base 11 securely receives the dielectric housing 2 therein. The longitudinal protrusion 113 of the base 11 is received in the longitudinal recess 22 of the dielectric housing 2 thereby preventing the dielectric housing 2 from moving toward the side wall of the base 11. The insertion piece 114 of the longitudinal protrusion 113 is inserted into the slot 24 of the dielectric housing 2 to prevent the end edges of the base 11 from forming a gap therebetween thereby enhancing shielding effects. The posts 21 of the dielectric housing 2 are received in the openings 112 of the base 11 and abut against an edge of the top surface thereof. The board 23 of the dielectric housing 2 abuts against an edge of the bottom surface of the base 11 opposite the edge of the top surface. The tongues 115 of the base 11 are snappingly received in the notches 25 of the dielectric housing 2 thereby preventing the dielectric housing 2 from moving along the longitudinal protrusion 113.

The dielectric housing 2 defines two offsetting rows of dove-tailed mortises 27. Each terminal 3 forms a dove-tailed tenon 32 received in the corresponding mortise 27 of the dielectric housing 2 thereby stabilizing the terminal 3 therein. Moreover, since the terminals 3 are arranged in two offsetting rows, the terminals 3 facilitate being soldered.

The second U-shaped shell 42 forms an inwardly extending latch 423 opposite the V-shaped cover 43 for mating with the slot 24 of the dielectric housing 2 thereby enhancing the engagement between the first and second shields 1, 4. The V-shaped cover 43 forms two elongate projecting ribs 431 on an inner surface thereof. In assembly, a cable 5 soldered to the solder tails 32 of the terminals 2 extends through the V-shaped cover 43 which is then stamped and deformed into a ring with the projecting rib 43 projecting into the cable 5 thereby increasing the retention force between the connector and the cable 5.

It is understood that the invention may be embodied in other specific forms without departing from the spirit of the central characteristics thereof. Thus, the present examples and embodiments are to be considered in all respects as illustrative and not restrictive, and the invention is not to be limited to the details given herein.

What is claimed is:

1. A cable connector comprising:

a first shield having a base and a first shell connected with a top surface of the base, the top surface of the base having an opening in opposite sides proximate the first shell, side walls of the base each forming a tongue proximate the first shell, a bottom surface of the base having two end edges coupled together to form an inwardly longitudinal protrusion along a central portion thereof, an insertion piece extending from a distal end of the longitudinal protrusion proximate the first shell;

a dielectric housing substantially received in the base, the dielectric housing having a pair of posts projecting from a top surface thereof for insertion into the openings of the base and a board projecting from a bottom surface thereof, the bottom surface having a longitudinal recess for snappingly receiving the longitudinal protrusion, side walls of the dielectric housing each forming a notch for receiving the tongue of the base, the board defining a slot in communication with the longitudinal recess for receiving the insertion piece; and a second shield having a second shell engaged with the first shell and a cover extending from the second shell for enclosing a cable, the second shell forming a latch opposite the cover for mating with the slot of the dielectric housing; wherein said first and second shells are U-shaped.

2. The cable connector as described in claim 1, wherein the cover forms two elongate projecting ribs on an inner surface thereof.

3. The cable connector as described in claim 1, wherein side walls of the second shell each form an inwardly projecting narrow finger, and wherein a cutout is defined in each side wall of the base of the first shield corresponding to the narrow finger.

4. The cable connector as described in claim 1, wherein side walls of the second shell each form an inwardly projecting wide finger, and wherein a hole is defined in opposite side walls of the first shell corresponding to the wide finger.

5. The cable connector as described in claim 1, wherein the cover is V-shaped.

6. The cable connector as described in claim 1, wherein the dielectric housing defines two offsetting rows of dove-tailed mortises for receiving a corresponding number of terminals having dove-tailed tenons.

7. A cable connector comprising:

a first shield (1) having a base (11) and a first U-shaped shell (12), said base (11) having an inwardly longitudinal protrusion (113) with an insertion piece (114) extending inwardly from one end thereof;

a dielectric housing (2) generally received within the first shield (12), said housing (2) including a bottom face having a longitudinal recess (22) therein for snappingly receiving said inwardly longitudinal protrusion (113) therein, and a board (23) extending from the bottom face of the housing (2) and having a slot (24) in communication with the longitudinal recess (22); and a second shield (4) having a second U-shaped shell (42) engaged with the first U-shaped shell (12) and a cover (43) extending from the second U-shaped shell (42) for enclosing a cable, said second U-shaped shell (42) forming an inward latch (423) opposite the cover (43) for being received within the slot (24) and engaged with the insertion piece (114) of the first shield (1).

* * * * *